US007051785B2

(12) United States Patent
Dewispelaere et al.

(10) Patent No.: US 7,051,785 B2
(45) Date of Patent: May 30, 2006

(54) AS CAST AND TRIMMED BORES IN A FRONT HEAD MEMBER OF AN AIR CONDITIONING COMPRESSOR ASSEMBLY

(75) Inventors: Bradley Joseph Dewispelaere, Lockport, NY (US); Philip LaRoach, Lockport, NY (US); Michael J Hampton, Liberty, IN (US); Andrew W Gifford, Sprineboro, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/869,337

(22) Filed: Jun. 16, 2004

(65) Prior Publication Data

US 2005/0279480 A1 Dec. 22, 2005

(51) Int. Cl.
*B22D 17/00* (2006.01)

(52) U.S. Cl. ..... 164/113; 164/132

(58) Field of Classification Search ..... 164/113, 164/132, 235, 369

See application file for complete search history.

(56) References Cited

U.S. PATENT DOCUMENTS 4,790,727 A * 12/1988 Steele ..... 417/269
5,878,488 A * 3/1999 Muirhead ..... 29/890.035

FOREIGN PATENT DOCUMENTS

JP 2001065457 * 5/2001

* cited by examiner

*Primary Examiner*—Kevin Kerns
*Assistant Examiner*—I.-H. Lin
(74) *Attorney, Agent, or Firm*—Patrick M. Griffin

(57) ABSTRACT

The subject invention provides a method of manufacturing an air conditioning compressor assembly for a vehicle having a front head member. A forming die having a cover half and an ejector half is shaped to define the features of the front head member. A conventional casting process is used to form the front head member. The front head member is cast to include a plurality of sealing surfaces, each concentric with a bore. A fastener passes through the bore to secure the front head member to the compressor housing such that a head portion of the fastener is in sealing engagement with the sealing surface as cast into the front head member to provide a pressure tight seal therebetween.

8 Claims, 4 Drawing Sheets

AS CAST AND TRIMMED BORES IN A FRONT HEAD MEMBER OF AN AIR CONDITIONING COMPRESSOR ASSEMBLY

BACKGROUND OF THE INVENTION

1. Field of the Invention

The subject invention relates to an air conditioning compressor assembly for a vehicle. More specifically, the subject invention relates to a method of manufacturing and attaching the front head member for the air conditioning compressor assembly.

2. Description of the Related Art

An Air conditioning compressor assembly for a vehicle comprises a housing that is typically constructed from a plurality of members. The compressor housing must maintain a gas tight seal against leakage. The compressor housing is closed on one end by a front head member. The front head member includes a bore through which a fastener (screw) passes therethrough for attaching the front head member to the compressor housing. It is common within the industry to refer to the fastener as a bolt. It should be understood that reference to the fastener includes like references to a screw, bolt, or the like. The compressor housing includes a closed or "blind" threaded aperture for receiving a threaded end of the fastener. The threaded aperture is not required to maintain a pressure tight seal as it is not exposed to the exterior of the compressor assembly.

The fastener includes a head portion with a shank portion extending axially therefrom. The head portion of the fastener covers an exterior sealing surface concentric with the bore. A pressure tight seal must be maintained between the fastener and the front head member sealing surface for preventing the leakage of a pressurized gas from the compressor assembly.

The compressor housing and the front head member are typically made of an aluminum alloy for weight reduction and ease of manufacture. The fastener is typically made of steel. The front head member bore has a diameter slightly greater than the diameter of the shank of the fastener. The difference in diameters provides a radial clearance therebetween to allow for easier insertion of the fastener through the bore.

The sealing surface is disposed on an exterior surface of the front head member and is concentric with the bore. The sealing surface is machined down into the outer surface of the front head member to assure a suitable flat surface for the fastener to seal against.

Traditionally, a sealing washer was used to form the seal between the fastener and the sealing surface. Recently, however, the fastener has been provided with a sealing pad disposed on a bottom surface of the head portion of the fastener for maintaining the pressure tight seal without the use of the sealing washer. The head portion of the fastener is therefore in direct sealing engagement with the machined sealing surface of the front head member.

It has been the common practice to cast the front head member of the compressor housing from an aluminum alloy using traditional die casting techniques. The bore and the sealing surface are either machined in separate and costly operations, or machined with a costly compound tool operation.

BRIEF SUMMARY OF THE INVENTION AND ADVANTAGES

The subject invention provides a method of manufacturing an air conditioning compressor assembly for a vehicle including a front head member having a sealing surface concentric with a bore for receiving a fastener therethrough. The method comprises the steps of shaping a forming die to define the front head member to include the bore and the sealing surface. The method further includes the step of casting the front head member in the forming die to include the bore and the sealing surface such that the bore and the sealing surface are formed in the step of casting.

Accordingly, the subject invention provides a method of manufacturing an air conditioning compressor assembly having a front head member in which the sealing surface and the bore are formed in the front head member during the step of casting the front head member. As such, the subject invention provides a more efficient and less costly method of manufacturing the compressor assembly.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
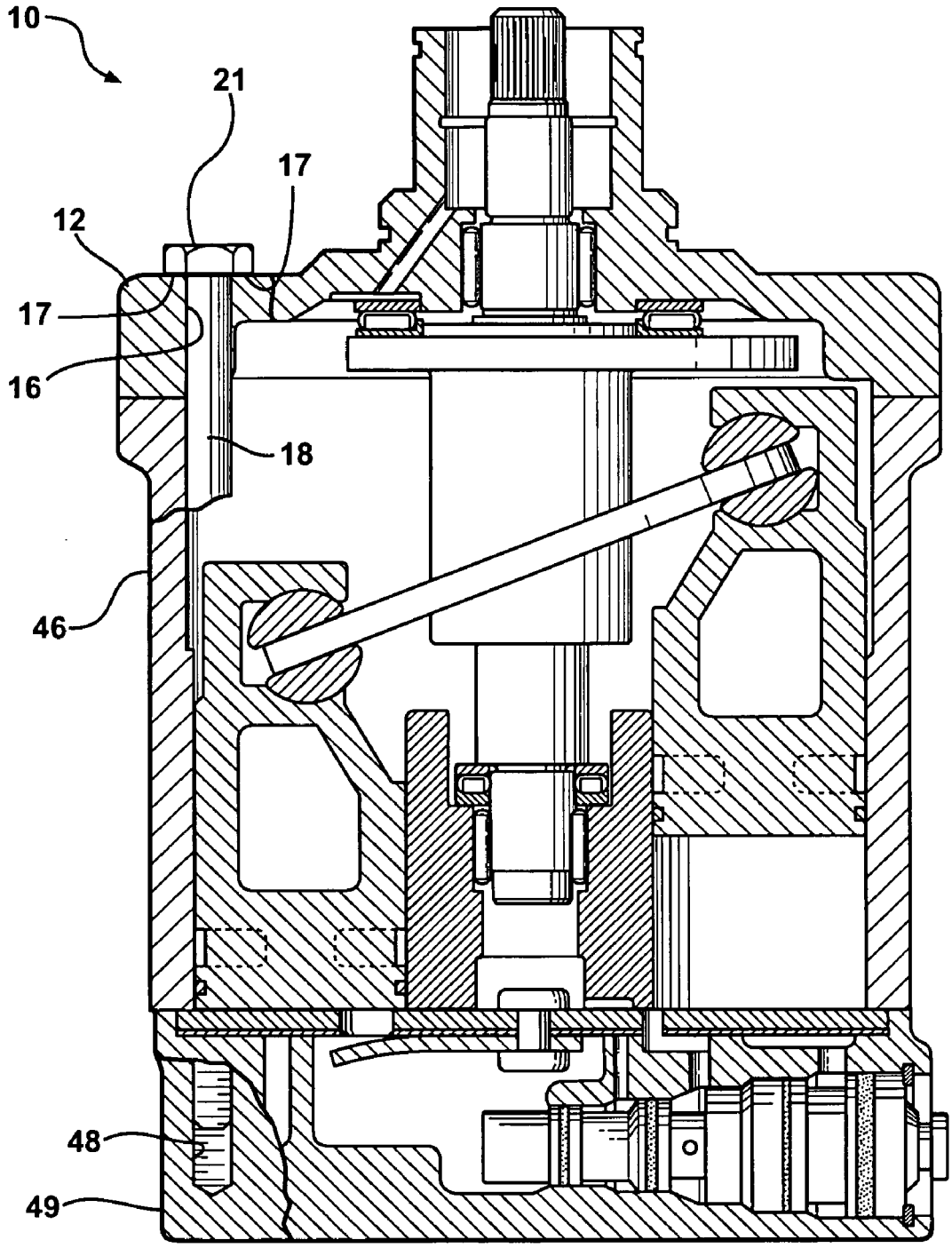
FIG - 1 PRIOR ART
FIG. 1 is a cross-sectional view of an air conditioning compressor assembly.

Referring to the Figures, wherein like numerals indicate like parts throughout the several views, an air conditioning compressor assembly is shown at 10 in FIG. 1.

Figure 2:
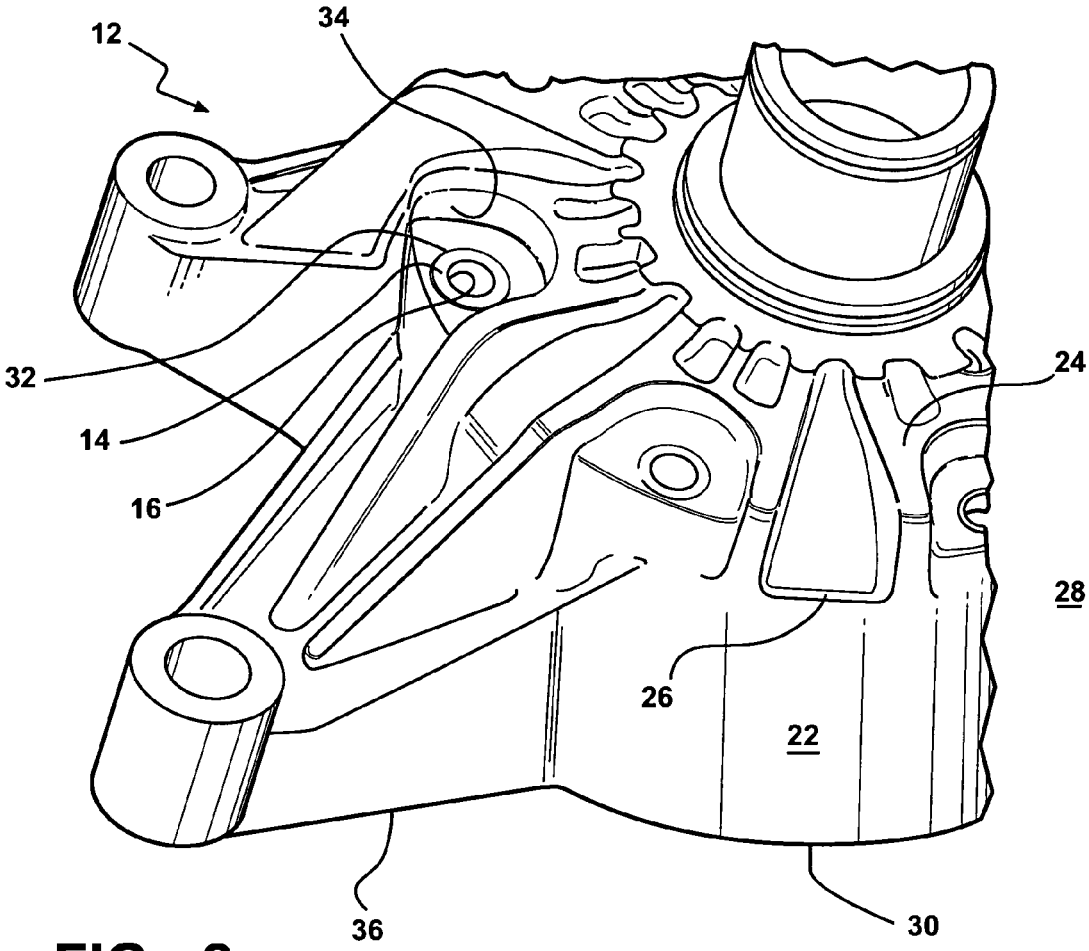
FIG. 2 is a fragmentary perspective view of a front head member of the air conditioning compressor assembly.

Referring to FIG. 2, the subject invention discloses a method of manufacturing an air conditioning compressor assembly 10 for a vehicle having a front head member 12. The front head member 12 includes a sealing surface 14 concentric with a bore 16 for receiving a fastener 18 therethrough. The front head member will be described with only one bore 16 concentric with a sealing surface 14. One skilled in the art, however, will recognize that the front head member will include a plurality of bores 16, each having a concentric sealing surface 14. Likewise, one skilled in the art will recognize that the compressor assembly 10 will include a corresponding number of fasteners 18 to pass through the plurality of bores 16, each sealing against a sealing surface 14 concentric with the bore 16. Therefore, it is to be understood that the reference to a single bore 16, fastener 18, or sealing surface 14 shall cover any number of each.

The method comprises the steps of shaping a forming die to define the front head member 12 to include the bore 16 and the sealing surface 14, and then casting the front head member 12 in the forming die. The front head member 12 is cast to include the bore 16 and the sealing surface 14 such that a sealing pad 17 of the fastener 18 is ready to mate with the sealing surface 14 as cast, for providing a pressure tight seal therebetween.

Figure 3:
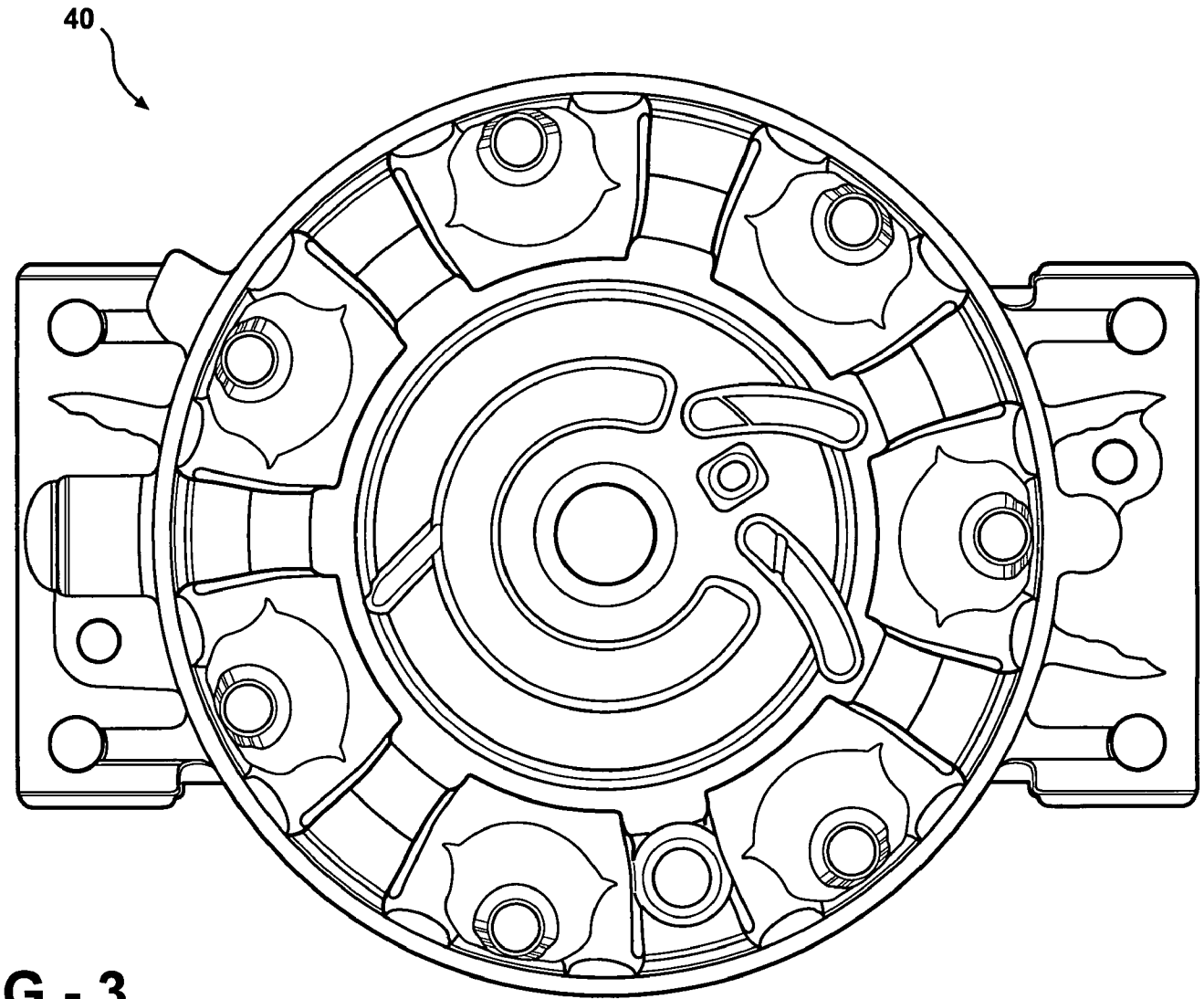
FIG. 3 is a plan view of an ejector half of a traditional forming die.
Figure 4:
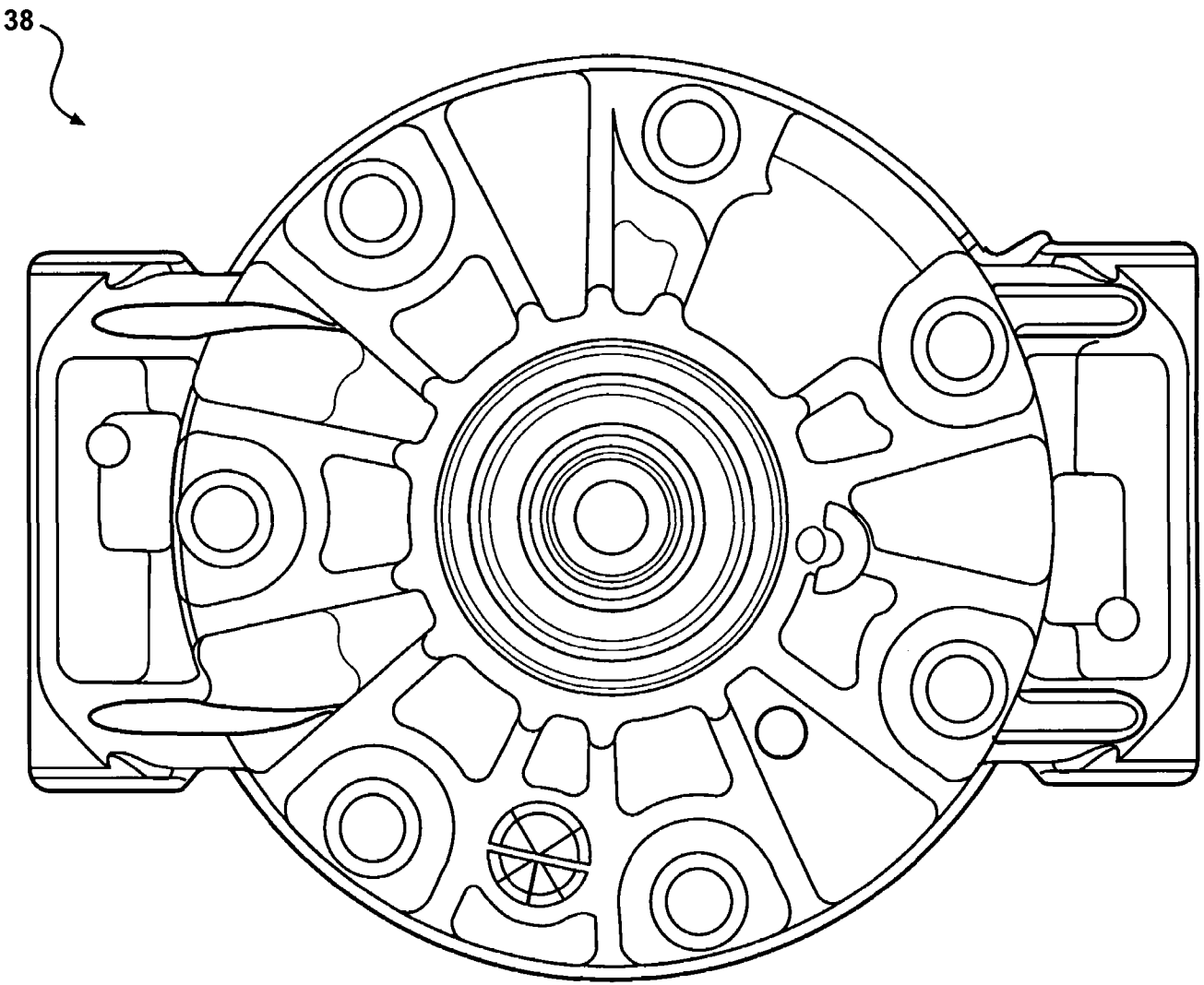
FIG. 4 is a plan view of a cover half of the traditional forming die.

A conventional die casting process is used in which the forming die shapes the front head member 12 to include two front head member halves, a cover half 38 and an ejector half 40, shown in FIGS. 3 and 4 respectively. The cover half 38 and the ejector half 40 define the features of the front head member 12. During the casting process, the cover half 38 and the ejector half 40 portions of the forming die are urged together under pressure. A molten metal alloy is introduced into the forming die, thereby taking the shape defined by the forming die. The formed metal alloy cools, thereby solidifying and forming the front head member 12.

The forming die is used in the casting process as a mold to define a shape of the front head member 12. Referring back to FIG. 2, the front head member 12 is cast to include a cylindrical outer wall 22 and an end wall 24 disposed at a first end 26 of the outer wall 22. The outer wall 22 and the end wall 24 define an interior cavity 28 open to a distal end 30 of the outer wall 22. The sealing surface 14 is disposed on an outer surface of the end wall 24. The bore 16 is concentric with the sealing surface 14 and extends through the end wall 24 into the interior cavity 28 of the front head member 12. The sealing surface 14 is disposed on a flat surface or on an upstanding ridge 32 that is concentric with the bore 16. An upstanding ridge 32 is formed by a depression around the sealing surface 14 to provide clearance for the fastener head HEX. The resulting elevated sealing surface is preferably no larger in diameter than the sealing pad 17 on the fastener 18 to allow greater profile tolerance on the as cast front head member sealing surface 14 when the fastener 18 has a non-cylindrical head shape, i.e. a hex head.

The front head member 12 is further cast to include a recess 34 in the end wall 24 of the front head member 12. The sealing surface 14 and the bore 16 are disposed within the recess 34. Preferably, the recess 34 is semi-circular and open to the outer wall 22 of the front head member 12. However, the subject invention is not limited to a front head member with a recess 34.

A plurality of support lugs 36 are cast into the front head member 12 and extend radially outward from the cylindrical outer wall 22. The support lugs 36 attach the compressor assembly to the vehicle. Preferably, the compressor assembly is attached to a motor such that the motor powers the compressor assembly. The support lugs 36 can be of any size or shape necessary to facilitate attachment to the intended vehicle.

As alluded to above, the front head member 12 may include a plurality of bores 16, each of which, as described above, is concentric with a corresponding sealing surface 14. It is to be understood that the reference to a single bore 16, sealing surface 14, fastener 18, threaded recess 34, encompasses one of any number of corresponding components.

Figure 5:
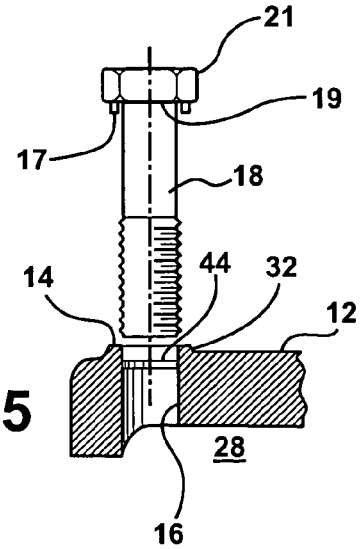
FIG. 5 is an enlarged fragmentary view of the front head member.

Referring to FIG. 5, the casting process creates a die parting line flash 44 where the cover half 38 and the ejector half 40 of the forming die engage each other. The die parting line flash 44 creates a thin web within the bore 16. The thin web must be removed for the fastener 18 to pass through the bore 16. Therefore, the method of manufacturing the front head member 12 further includes the step of removing the die parting line flash 44, and particularly, the thin web from within the bore 16. The die parting line flash 44 is removed to provide an adequately sized passageway to allow the fastener 18 to pass unobstructed therethrough.

Referring to FIG. 1, the front head member 12 is attached to a compressor housing 46 by the fastener 18. The fastener 18 extends through the bore 16 and into threaded engagement with a threaded recess 48 of a compressor rear head 49. In this manner, the head sealing pad 17 of the fastener 18 is engaged against the mating sealing surface 14 as cast. It is to be understood that the subject invention may apply to either a compressor assembly with a separate or integral rear head member 49.

The sealing surface 14, as cast, is defined as the sealing surface 14 as formed during the step of casting, without any additional machining operations to perfect the sealing surface 14. As such, the sealing surface 14 is ready to mate with the head sealing pad 17 of the fastener 18 to form a pressure tight seal therebetween. The head sealing pad 17 of the fastener 18 is upstanding with a rounded corner fillet, disposed on a bottom surface 19 of a head portion 21 of the fastener 18. The sealing pad 17 engages the sealing surface 14 as cast, without the use of a sealing washer therebetween. As the fastener 18 is tightened, the sealing pad deforms against the sealing surface 14 as cast, forming the pressure tight seal between the sealing pad of the fastener 18 and the sealing surface 14 of the front head member 12. The sealing pad 17 of the fastener 18 is therefore in direct sealing contact with the sealing surface 14 as cast.

There are many suitable metal alloys that may be used in the casting process that are known to those skilled in the art, however, the preferred metal is an aluminum alloy. The aluminum alloy is lightweight and provides the necessary strength for the front head member 12.

The foregoing invention has been described in accordance with the relevant legal standards; thus, the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of manufacturing a front head member of an air conditioning compressor assembly for a vehicle including a sealing surface concentric with a bore, said method comprising the steps of:

shaping a forming die to define the front head member including the bore and the sealing surface; and casting the front head member in the forming die to include the bore and the sealing surface such that the bore and the sealing surface are formed in said step of casting.

2. A method as set forth in claim 1 wherein said step of casting further includes forming the front head member to include a cylindrical outer wall with an end wall defining an interior cavity therein such that the sealing surface is disposed on an outer surface of the end wall and the bore extends therethrough.

3. A method as set forth in claim 2 wherein said step of casting further includes forming the front head member to include a recess in the end wall wherein the bore and the sealing surface are disposed within the recess.

4. A method as set forth in claim 3 wherein said step of casting further includes forming the front head member to include a plurality of support lugs extending radially outward from the cylindrical outer wall.

5. A method as set forth in claim 4 wherein said step of casting further includes forming the front head member to include a depression concentric with the sealing surface for providing clearance for a head portion of a fastener.

6. A method as set forth in claim 1 wherein said method further includes forming and removing a die parting line flash from within the bore to allow passage of a fastener therethrough.

7. A method as set forth in claim 1 wherein said step of casting the front head member is further defined as casting the front head member from an aluminum alloy.

8. A method of manufacturing an air conditioning compressor assembly for a vehicle including a front head member having a sealing surface concentric with a bore wherein the front head member is attached to a compressor housing by a fastener, said method comprising the steps of:

shaping a forming die to define the front head member including the bore and the sealing surface;

casting the front head member in the forming die to include the bore and the sealing surface; and extending the fastener through the bore and into threaded engagement with the compressor housing for attaching the front head member to the compressor housing and engaging a head portion of the fastener against the sealing surface as cast.

* * * * *